United States Patent [19]

Hsu

[11] 4,189,926

[45] Feb. 26, 1980

[54] TURBINE-CONDENSER SUPPORT SYSTEM

[75] Inventor: James J. Hsu, Cincinnati, Ohio

[73] Assignee: Westinghouse Electric Corp., Pittsburgh, Pa.

[21] Appl. No.: 915,690

[22] Filed: Jun. 15, 1978

[51] Int. Cl.[2] ..... F01K 11/00

[52] U.S. Cl. ..... 60/687; 60/692

[58] Field of Search ..... 60/685, 687, 688, 689, 60/690, 692

[56] References Cited

U.S. PATENT DOCUMENTS

| | | | |
|---|---|---|---|
| 2,531,178 | 11/1950 | Van Nest | 60/687 |
| 3,312,447 | 4/1967 | Bellati et al. | 60/687 X |

*Primary Examiner*—Allen M. Ostrager
*Attorney, Agent, or Firm*—J. W. Keen

[57] ABSTRACT

A subatmospheric pressure condenser has an enclosure within which steam is condensed after exhausting from an associated turbine. The enclosure is flexibly connected to the turbine to permit relative movement therebetween. The condenser also has an outer wall which is flexibly connected to the enclosure to define a vacuum balancing chamber therebetween with the outer wall being structurally connected to the turbine for the purpose of reducing the atmospheric pressure force exerted on the turbine's structure by the turbine. The structural connectors between the outer wall and the turbine intersect the enclosure and provide fluid communication therethrough between the turbine's exhaust port and the vacuum balancing chamber. At the intersection between the structural connectors and the enclosure, sleeves are attached to the enclosure in closely spaced surrounding relationship with each of the structural connectors to minimize liquid intrusion therebetween from the enclosure to the vacuum balancing chamber. Since the outer wall is flexibly connected to the enclosure and the vacuum balancing chamber has little or no water intrusion, the outer wall efficiently transmits atmospheric pressure forces exerted thereon through the structural connectors to the turbine and reduce the load on and thus the required size of the turbine's support structure. The sleeve members which fit about the structural connectors permit relative movement therebetween and extend a predetermined distance from the enclosure to further minimize water leakage into and subsequent accumulation thereof in the vacuum balancing chamber.

5 Claims, 1 Drawing Figure

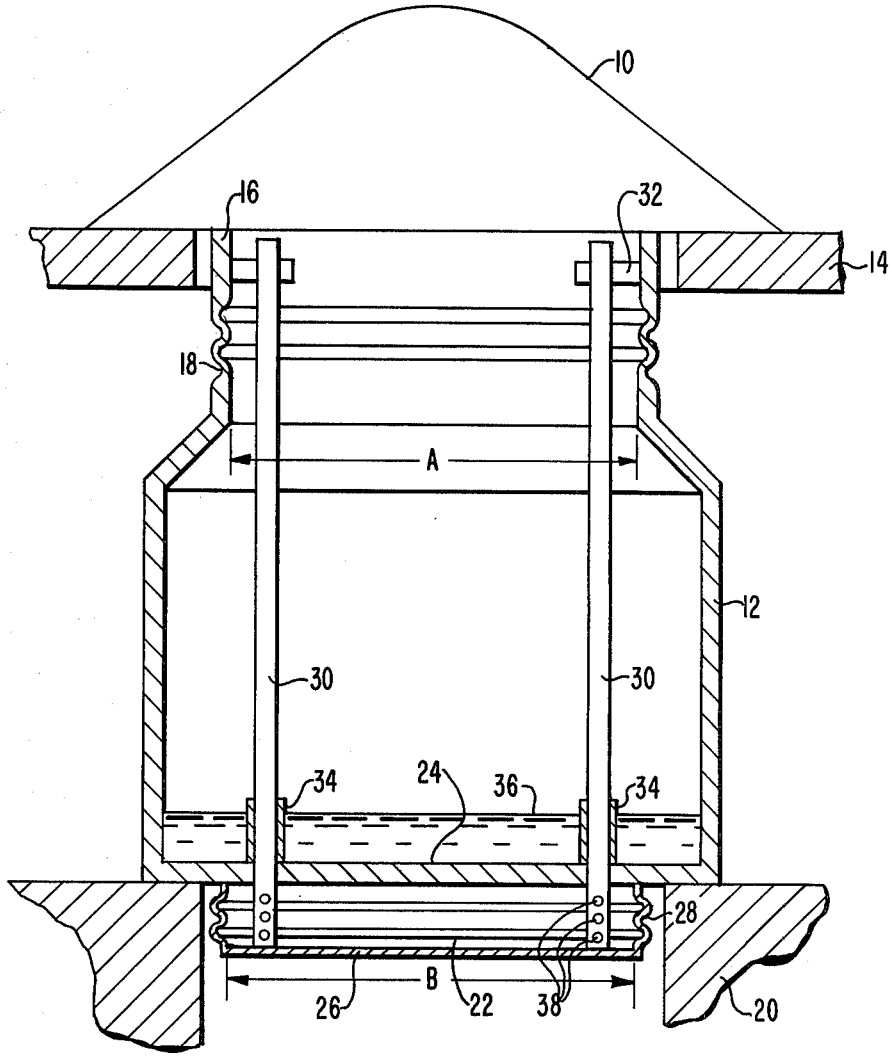
10
16
32
14
18
A
12
30
30
34
24
36
34
28
B
26
22
38
20

TURBINE-CONDENSER SUPPORT SYSTEM

BACKGROUND OF THE INVENTION

1. Field of the Invention

This invention relates to elastic fluid turbines and associated condensers, and more particularly to support configurations between such turbine and condenser.

2. Description of the Prior Art

Some of the stages in low pressure central station steam turbines typically operate at subatmospheric pressure and thus cause the turbine to be subjected to large atmospheric pressure forces which have commonly been balanced by the turbine's supporting structure. Subatmospheric pressure steam condensers for large central station applications are usually arranged beneath the low pressure turbine and its supporting structure and are connected to the low pressure turbine through a flexible expansion joint which permits relative motion between the turbine and condenser while preventing atmospheric leakage into the condenser. The condenser usually has its own support structure for bolstering weight of the condenser. Such condensers normally have a net atmospheric pressure force directed toward the turbine in the upward direction, but that force is greatly reduced by the weight of the condensate which collects in the bottom or hot-well of the condenser.

Until relatively recently, the support structure for central station turbines commonly consisted of reinforced concrete which also acted as a foundation for additional power generation apparatus. Since reinforced concrete was typically used for the turbine's pedestal, there was little cost savings incentive for reducing the turbine's atmospheric pressure force on its support structure. Recently, however, a new concept in central station power generation has evolved. The new concept includes launching large seagoing vessels containing power generation equipment such as turbines, condensers, etc. Support of such turbines necessitates use of relatively light-weight structures such as steel or other high strength structural components. As such, it has become important to minimize the size and weight of such supporting structures while maintaining the supportive capabilities necessary to bolster large central station turbines and associated apparatus.

A copending patent application by J. R. Dickey entitled "Condenser Vacuum Load Compensating System" is assigned to the assignee of the present invention, has a Ser. No. of 856,064, and discloses a configuration which can be useful in minimizing the turbine's support requirements. The aforementioned patent application utilizes stand pipes 76 and 80 to communicably couple its vapor chamber to its condensate chamber. Disadvantages of such configuration include: relatively high probability of falling condensate entering the vapor chamber between the stand pipes and surrounded structural members which must be drained away; increased material requirements for the stand pipes to permit communicable coupling between them and the structural members; and the pressure communicated from the condensate chamber to the vapor chamber is not equal to the pressure at the turbine exhaust neck which is the optimum.

SUMMARY OF THE INVENTION

In general, the present invention comprises an elastic fluid turbine, a support structure for the turbine, a condenser having an enclosure and an outer wall which are flexibly connected and cooperatively define a vacuum balancing chamber which is in fluid communication with the enclosure and the exhaust port, and conduits which provide the aforementioned fluid communication therethrough and structurally connect the vacuum balancing chamber's outer wall to the turbine so as to reduce the atmospheric pressure force exerted on the turbine's supporting structure by the turbine. The vacuum balancing chamber's outer wall and turbine exhaust port are preferably substantially parallel with generally equal areas. Each conduit is preferably surrounded by a sleeve arranged in closely spaced relationship therewith so as to minimize liquid intrusion into the vacuum balancing chamber and thus promote maximum atmospheric pressure force transmission through the connecting conduit structural members from the vacuum balancing chamber's outer wall to the turbine. Such maximum force transmission results in force reduction on and consequent size reduction of the turbine's support structure.

BRIEF DESCRIPTION OF THE DRAWINGS

The objects and advantages of this invention will be more apparent from reading the following detailed description in connection with the accompanying drawings, in which:

The sole FIGURE is a partial sectional view of a turbine and condenser made in accordance with the present invention.

DESCRIPTION OF THE PREFERRED EMBODIMENT

Referring now to the drawing in detail, the sole FIGURE shows a partial sectional view of a turbine 10 and associated condenser 12 into which turbine 10 exhausts motive fluid. For purposes of illustration, turbine 10 is considered to be a steam condenser.

Large central station turbines and condensers typically assume the general arrangement illustrated in the sole FIGURE with the exhaust end of turbine 10 and condenser 12 often operating at subatmospheric pressure. Turbine 10 is usually almost entirely supported by support structure 14 which, according to the prior art, compensated for the turbine's weight and operational bending moments as well as the atmospheric pressure forces acting on the turbine. Exhaust neck 16 of turbine 10 is joined to condenser 12 by disposing expansion, flex joint 18 therebetween. Flex joint 18 is commonly used to avoid transmitting relative movement and vibration between turbine 10 and condenser 12. Condenser 12, as illustrated, is primarily supported by supports 20 which bear the weight of condenser 12 and the condensate which operationally collects on the condenser's bottom or hot well. The atmospheric pressure force exerted on the bottom of condenser 12 acts against condenser 12's weight force and tends to unload condenser supports 20.

The sole FIGURE illustrates a vacuum balancing chamber 22 formed between condenser 12's enclosure wall 24 and outer wall 26. Outer wall 26 is flexibly attached to enclosure wall 24 by expansion joint 28 so as to permit relative movement therebetween. Outer wall 26 is, by example, connected to turbine exhaust neck 16 by structural connecting conduit members 30 whose size, number, and distribution are dependent on the particular application and its configuration. Conduit members 30 are illustrated as being joined to exhaust neck 16 by braces 32, but it is to be understood that conduit members 30 may be attached directly to any portion of turbine 10.

Sleeves 34 are connected to enclosure 24 and extend therefrom a distance greater than the normal condensate level as indicated by reference numeral 36. Sleeves 34 permit free relative movement of and closely surround conduits 30 so as to minimize condensate intrusion therebetween into vacuum balancing chamber 22. Accumulation of condensate within vacuum balancing chamber 22 would tend to partially offset the atmospheric pressure force exerted on outer wall 26 and subsequently reduce the compensating force transmitted through conduits 30 to turbine 10. If, due to the particular application, liquid sealing between sleeves 34 and structural connecting conduit members 30 is deemed inadequate, means for draining vacuum balancing chamber 22 may be necessitated.

Structural connecting conduit members 30 provide fluid communication between the exhaust neck 16 and vacuum balancing chamber 22 through openings 38 in the connecting conduits 30 and thus insure pressure equalization therebetween. To further insure atmospheric pressure force equalization on outer wall 26 and turbine 10, area "A" across the turbine's condenser neck 16 and area "B" which is the parallel projection of outer wall 26 are chosen to be substantially equal.

While conduit members 30 are illustrated as being round, they may assume any shape and size which are suitable for the particular application in which they are to be utilized. It is to be further understood that sleeves 34 may be deleted if other sealing means are provided about each structural connecting conduit member 30 and/or a drainage system for bleeding off condensate accumulated within vacuum balancing chamber 22 is included.

It will now be apparent that an improved turbine-condenser configuration and supporting arrangement has been provided in which the turbine supports 14 have less strenuous strength requirements imposed than heretofore with little additional structural complexity. The present invention additionally provides more precise pressure balancing on the turbine, material and associated installation savings on its relatively smaller sleeves, and structural members which also provide the more precise pressure balancing fluid communication.

What we claim is:

1. A turbine-condenser support configuration comprising:

an elastic fluid turbine having an exhaust port for exhausting motive fluid therethrough;

a support structure for bolstering said turbine;

a condensing apparatus in fluid communication with said turbine through said exhaust port, said condenser constituting an enclosure within which the motive fluid is condensed and an outer wall which is flexibly joined thereto to define a vacuum balancing chamber, said flexible joint permitting relative movement of said enclosure and outer wall; and means for rigidly connecting said outer wall to said turbine, said connecting means providing atmospheric pressure force transmissibility from said outer wall so as to reduce the load on the turbine's support structure;

said connecting means comprising a plurality of conduits which extend through said enclosure and provide fluid communication between the turbine's exhaust port and vacuum balancing chamber for equalizing the pressure therebetween.

2. The turbine-condenser support configuration of claim 1 wherein said outer wall and said turbine exhaust port have substantially equal areas.

3. The turbine-condenser support configuration of claim 2 wherein said outer wall and turbine exhaust port are substantially parallel.

4. The turbine-condenser support configuration of claim 1, said enclosure including a plurality of sleeve members which extend therefrom, each of which is of a predetermined length and in closely spaced surrounding relation with one of said conduits to minimize fluid communication between said sleeves and conduits into said vacuum balancing chamber.

5. The turbine-condenser support configuration of claim 1 wherein said conduits are attached to said outer wall with fluid communication to said vacuum balancing chamber being provided by openings in the conduits' walls.

* * * * *